US008523525B2

(12) United States Patent
Marra

(10) Patent No.: US 8,523,525 B2
(45) Date of Patent: Sep. 3, 2013

(54) SNUBBER ASSEMBLY FOR TURBINE BLADES

(75) Inventor: John J. Marra, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 882 days.

(21) Appl. No.: 12/701,041

(22) Filed: Feb. 5, 2010

(65) Prior Publication Data

US 2011/0194939 A1 Aug. 11, 2011

(51) Int. Cl.
*F01D 5/26* (2006.01)

(52) U.S. Cl.
USPC ..... 416/96 R; 416/196 R

(58) Field of Classification Search
USPC ..... 416/195, 196 R, 96 R
See application file for complete search history.

(56) References Cited

U.S. PATENT DOCUMENTS 1,542,402 A * 6/1925 Meissner ..... 416/196 R
1,673,937 A * 6/1928 Davis ..... 416/196 R
1,723,321 A * 8/1929 Zubler ..... 416/196 R
1,749,449 A * 3/1930 Stevenson ..... 416/196 R
2,771,267 A * 11/1956 Weymouth, Jr. ..... 416/196 R
4,268,223 A * 5/1981 Anner et al. ..... 416/196 R
4,866,828 A 9/1989 Fraser
5,511,948 A 4/1996 Suzuki et al.
5,695,323 A 12/1997 Pfeifer et al.
6,682,306 B2 1/2004 Murakami et al.

* cited by examiner

*Primary Examiner* — Ninh H Nguyen

(57) ABSTRACT

A snubber associated with a rotatable turbine blade in a turbine engine, the turbine blade including a pressure sidewall and a suction sidewall opposed from the pressure wall. The snubber assembly includes a first snubber structure associated with the pressure sidewall of the turbine blade, a second snubber structure associated with the suction sidewall of the turbine blade, and a support structure. The support structure extends through the blade and is rigidly coupled at a first end portion thereof to the first snubber structure and at a second end portion thereof to the second snubber structure. Centrifugal loads exerted by the first and second snubber structures caused by rotation thereof during operation of the engine are at least partially transferred to the support structure, such that centrifugal loads exerted on the pressure and suctions sidewalls of the turbine blade by the first and second snubber structures are reduced.

20 Claims, 4 Drawing Sheets

SNUBBER ASSEMBLY FOR TURBINE BLADES

This invention was made with U.S. Government support under Contract Number DE-FC26-05NT42644 awarded by the U.S. Department of Energy. The U.S. Government has certain rights to this invention.

FIELD OF THE INVENTION

The present invention relates generally to a snubber assembly for turbine blades in a turbine engine, and, more particularly, to a snubber assembly that reduces circumferential loading imparted on sidewalls of the turbine blades during operation of the turbine engine.

BACKGROUND OF THE INVENTION

A turbomachine, such as a steam or gas turbine is driven by a hot working gas flowing between rotor blades arranged along the circumference of a rotor so as to form an annular blade arrangement, and energy is transmitted from the hot working gas to a rotor shaft through the rotor blades. As the capacity of electric power plants increases, the volume of flow through industrial turbine engines has increased more and more and the operating conditions (e.g., operating temperature and pressure) have become increasingly severe. Further, the rotor blades have increased in size to harness more of the energy in the working gas to improve efficiency. A result of all the above is an increased level of stresses (such as thermal, vibratory, bending, centrifugal, contact and torsional) to which the rotor blades are subjected.

In order to limit vibrational stresses in the blades, various structures may be provided to the blades to form a cooperating structure between blades that serves to dampen the vibrations generated during rotation of the rotor. For example, mid-span snubber structures, such as cylindrical standoffs, may be provided extending from mid-span locations on the blades for engagement with each other. Two mid-span snubber structures are located at the same height on either side of a blade with their respective contact surfaces pointing in opposite directions. The snubber contact surfaces on adjacent blades are separated by a small space when the blades are stationary. However, when the blades rotate at full load and untwist under the effect of the centrifugal forces, snubber surfaces on adjacent blades come in contact with each other to dampen vibrations by friction at the contacting snubber surfaces. A disadvantage of snubber damping is that the large bending stresses associated with large diameter blades typically necessitates larger snubber structures for mechanical stability to avoid outward bending of the snubber structure, resulting in increased bending stresses on the blade surfaces supporting the snubber. Specifically, the bending stresses of the snubber structures are transferred to the respective blade pressure and suction sidewalls, which can cause damage to the sidewalls, resulting in repair or replacement of the blades.

SUMMARY OF THE INVENTION

In accordance with one aspect of the invention, a snubber assembly is provided. The snubber assembly is associated with a rotatable turbine blade in a turbine engine, the turbine blade including a pressure sidewall and a suction sidewall opposed from the pressure wall. The snubber assembly comprises a first snubber structure associated with the pressure sidewall of the turbine blade, a second snubber structure associated with the suction sidewall of the turbine blade, and a support structure. The support structure extends through the blade and is rigidly coupled at a first end portion thereof to the first snubber structure and at a second end portion thereof to the second snubber structure. Centrifugal loads exerted by the first and second snubber structures caused by rotation thereof during operation of the engine are at least partially transferred to the support structure, such that centrifugal loads exerted on the pressure and suctions sidewalls of the turbine blade by the first and second snubber structures are reduced.

In accordance with another aspect of the invention, a method is provided of affixing a snubber assembly to a rotatable turbine blade of a turbine engine. The turbine blade includes a pressure sidewall and a suction sidewall opposed from the pressure sidewall and has a bore formed therein extending from the pressure sidewall through the turbine blade to the suction sidewall. A support structure is inserted into the bore in the turbine blade such that a first end portion of the support structure extends outwardly from the turbine blade pressure sidewall and a second end portion of the support structure extends outwardly from the turbine blade suction sidewall. The support structure is secured to the turbine blade within the bore. A first snubber structure is coupled to the first end portion of the support structure. A second snubber structure is coupled to the second end portion of the support structure. Centrifugal loads exerted by the first and second snubber structures caused by rotation thereof during operation of the engine are at least partially transferred to the support structure such that centrifugal loads exerted on the pressure and suctions sidewalls of the turbine blade by the first and second snubber structures are reduced.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
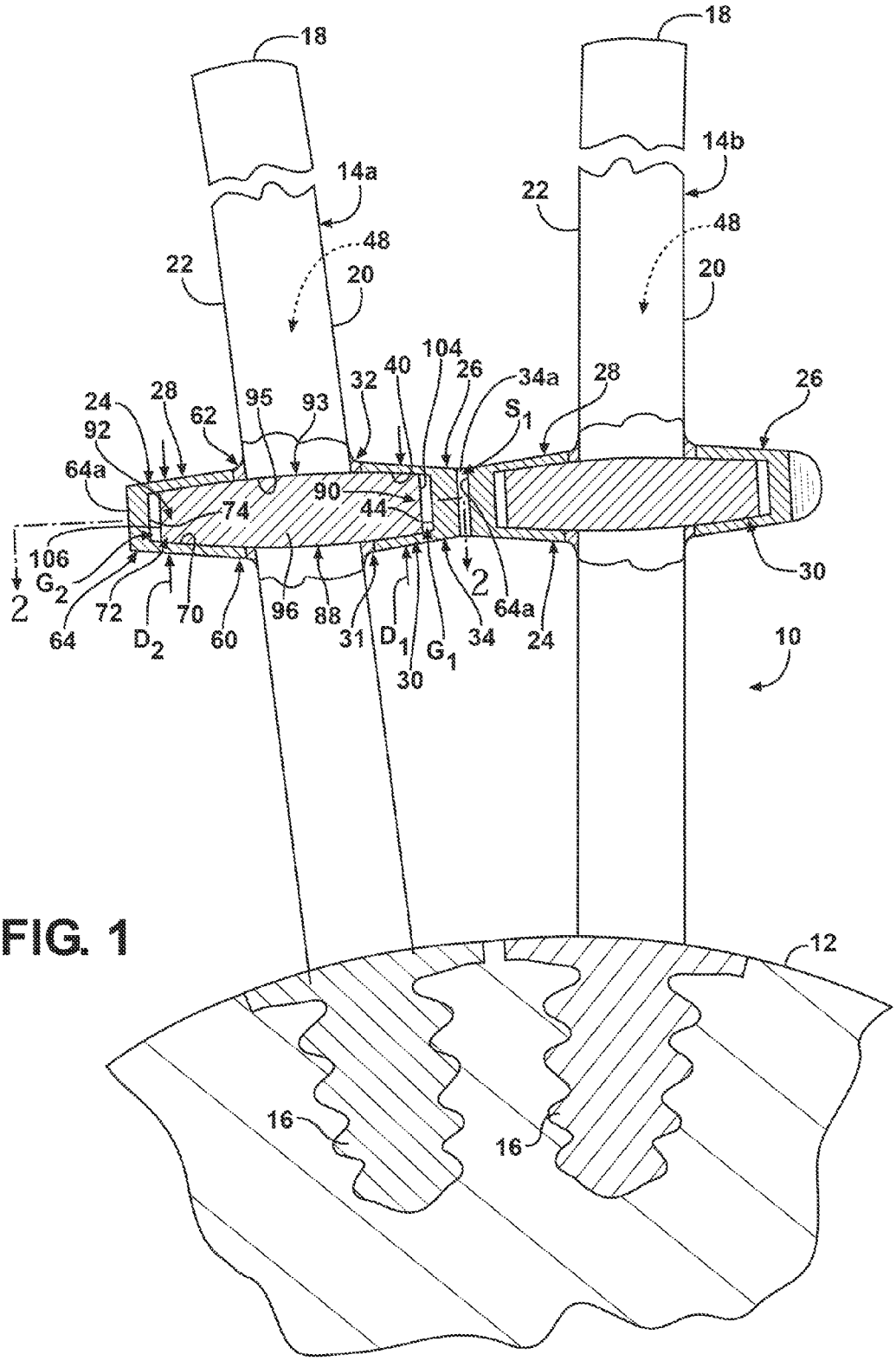
FIG. 1 is a partial end view of a rotor, as viewed in an axial flow direction, taken in a plane perpendicular to an axis of rotation and showing an embodiment of the invention.

Referring to FIG. 1, a section of a rotor 10 is illustrated for use in a turbomachine (not shown), such as for use in a gas or steam turbine engine. The rotor 10 comprises a rotor disc 12 and a plurality of blades 14, illustrated herein as a first blade 14*a* and an adjacent second blade 14*b*. The blades 14*a*, 14*b* comprise radially elongated structures extending from a blade root 16 engaged with the rotor disc 12, to a blade tip 18. Each of the blades 14*a*, 14*b* includes a pressure sidewall 20 and a suction sidewall 22 opposed form the pressure sidewall 20. Each of the blades 14*a*, 14*b* further includes a snubber assembly 24 located mid-span between the blade root 16 and the blade tip 18 of each of the blades 14*a*, 14*b*.

The snubber assembly 24 associated with the first blade 14*a* will now be described, it being understood that the snubber assemblies 24 of the other blades 14 are substantially identical to the snubber assembly 24 described herein. As most clearly shown in FIG. 4, the snubber assembly 24 comprises a first snubber structure 26, a second snubber structure 28, and a support structure 30. The first and second snubber structures 26, 28 may comprise a nickel based alloy, such as, for example, CM247-DS or PWA1483. The support structure 30 may also comprise a nickel based alloy, such as, for example, INCONEL 718 (INCONEL is a registered trademark of Special Metals Corporation, located in New Hartford, N.Y.) It is noted that the material selected for the first and second snubber structures 26, 28 preferably has good oxidation, corrosion, and/or creep resistance and the material selected for the support structure 30 is preferably a high strength material. It is also noted that it may be preferable to form both the first and second snubber structures 26, 28 and the blade 14*a* from the same/similar material, but to form the support structure 30 from a different material than the first and second snubber structures 26, 28 and the blade 14*a*. Hence, the material properties of these components can be closely matched to the requirements of the respective components. For example, since the support structure 30 is not directly exposed to the high temperature gases flowing through the engine, it need not have as good of oxidation, corrosion, and/or creep resistance as the first and second snubber structures 26, 28 and the blade 14*a*, which are directly exposed to the high temperature gases flowing through the engine. Moreover, since bending loads are transferred to the support structure 30, as will be discussed herein, the support structure 30 is preferably formed from a high strength material.

Figure 2:
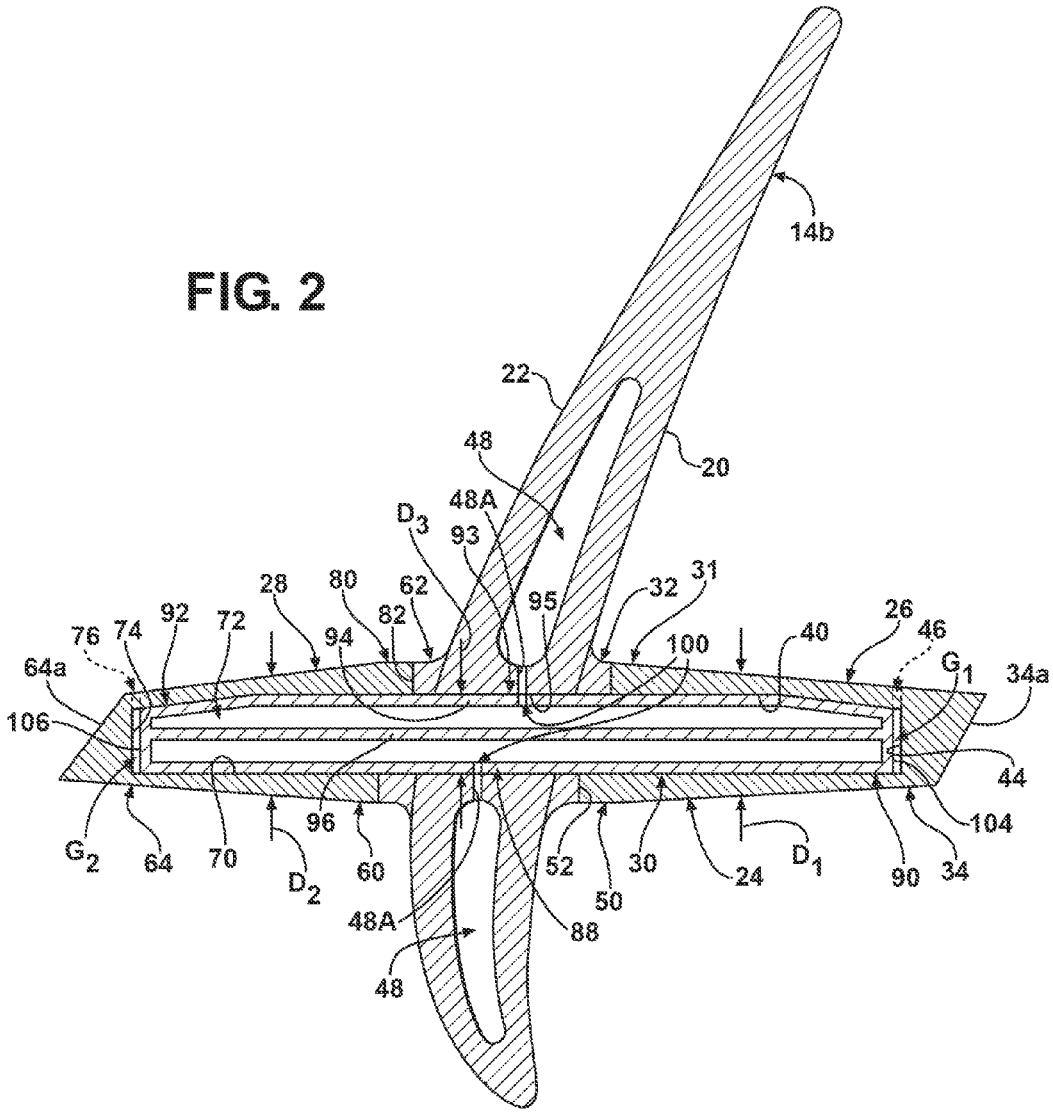
FIG. 2 is view taken on the plane indicated by the line 2-2 in FIG. 1.

Referring back to FIG. 1, the first snubber structure 26 is associated with and extends outwardly from the pressure sidewall 20 of the first blade 14*a* toward the suction sidewall 22 of the second blade 14*b*. As shown in FIGS. 1 and 2, the first snubber structure 26 includes a base portion 31 that is abutted against a first fillet 32, which first fillet 32 in the embodiment shown is integral with the pressure sidewall 20 of the first blade 14*a*. The first fillet 32 may act as a landing area for receiving the base portion 31 of the first snubber structure 26 during the assembly of the snubber assembly 24, as will be discussed in greater detail herein. In a preferred embodiment, the base portion 31 is in contact with but not affixed to the fillet 32, although the base portion 31 could be affixed to the fillet 32 if desired.

As shown in FIGS. 1 and 2, the first snubber structure 26 is a tapered cylindrical-shaped member having an outer diameter $D_1$ that decreases as the first snubber structure 26 extends away from the pressure sidewall 20, although it is understood that the first snubber structure 26 could have a generally constant outer diameter $D_1$ and could have other shapes as desired, such as, for example, elliptical, airfoil-shaped, etc.

An end portion 34 of the first snubber structure 26 in the embodiment shown defines a first angled surface 34*a*. The first angled surface 34*a* is spaced from a corresponding second angled surface 64*a* of a second snubber structure 28 of the adjacent second blade 14*b*, such that a first space $S_1$ is formed therebetween, see FIG. 1. As will be described below, during operation of the engine, as the blades 14 rotate they are "untwisted" slightly, such that the first angled surface 34*a* of the snubber assembly 24 of the first blade 14*a* comes into contact with the second angled surface 64*a* of the snubber assembly 24 of the second blade 14*b*.

Figure 4:
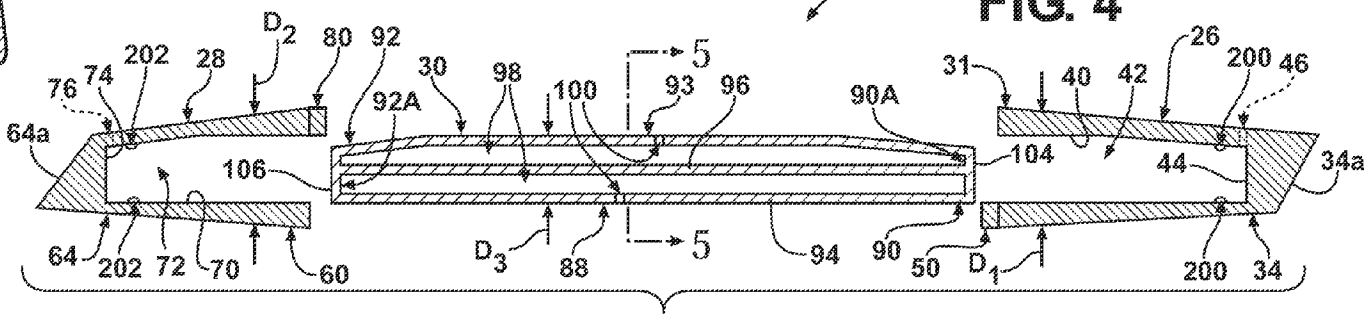
FIG. 4 is a view of the snubber assembly removed from the turbine blade of FIG. 3.

As shown in FIG. 4, the first snubber structure 26 includes an inner wall 40 that defines a hollow interior portion 42. The support structure 30 is received within the hollow interior portion 42 and affixed to the inner wall 40 as will be described in detail herein. The hollow interior portion 42 extends from the open end of the base portion 31 to an inner endwall 44 of the first snubber structure 26 that is located proximate to the end portion 34 thereof. It is noted that the inner endwall 44 could be located closer to the first blade 14*a* if desired, depending on the length of the support structure 30.

Referring to FIG. 4, the end portion 34 of the first snubber structure 26 includes a cooling fluid exit aperture 46 formed therein. The aperture 46 allows cooling fluid located in a first gap $G_1$, described below, to escape out of the first snubber structure 26. The cooling fluid may be provided into the first gap $G_1$ from the support structure 30, which support structure 30 may receive the cooling fluid from an interior cooling fluid channel 48 located within the first blade 14*a*, see FIG. 1. Additional details in connection with the cooling fluid in the support structure 30 will be discussed in detail herein. It is noted that the location and number of cooling fluid exit apertures 46 formed in the first snubber structure 26 may vary as desired.

Figure 3:
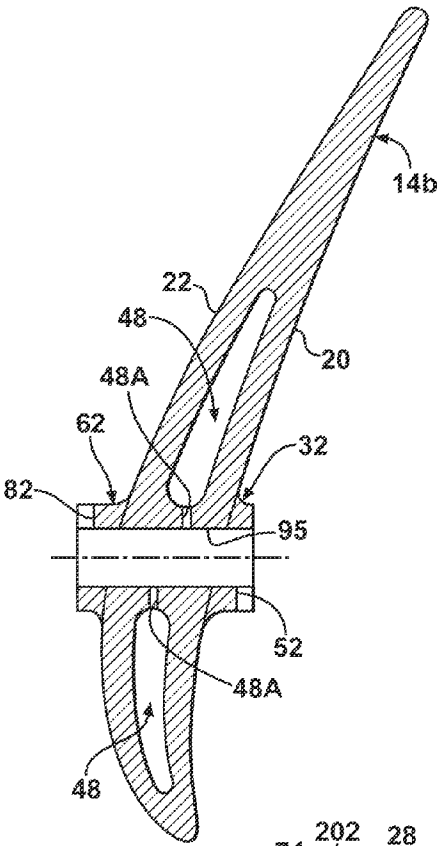
FIG. 3 is a view similar to that of FIG. 2 wherein a snubber assembly according an embodiment of the invention has been removed.

Referring to FIG. 2, the first snubber structure 26 includes antirotation structure 50, illustrated herein as an antirotation tab that extends outwardly from the base portion 31 toward the pressure sidewall 20 of the first blade 14*a*. The antirotation structure 50 is received in a corresponding indentation 52 formed in the fillet 32 (see also FIG. 3) such that the first snubber structure 26 is prevented from rotating with respect to the first blade 14*a* during operation of the engine.

Referring back to FIG. 1, the second snubber structure 28 is associated with and extends outwardly from the suction sidewall 22 of the first blade 14*a* toward the pressure sidewall (not shown) of an adjacent blade (not shown). As shown in FIGS. 1 and 2, the second snubber structure 28 includes a base portion 60 that is abutted against a second fillet 62, which second fillet 62 in the embodiment shown is integral with the suction sidewall 22 of the first blade 14*a*. The second fillet 62 may act as a landing area for receiving the base portion 60 of the second snubber structure 28 during the assembly of the snubber assembly 24, as will be discussed in greater detail herein. In the preferred embodiment, the base portion 60 is in contact with but not affixed to the fillet 62, although the base portion 60 could be affixed to the fillet 62 if desired.

As shown in FIGS. 1 and 2, the second snubber structure 28 is a tapered cylindrical-shaped member having an outer diameter $D_2$ that decreases as the second snubber structure 28 extends away from the suction sidewall 22, although it is understood that the second snubber structure 28 could have a generally constant outer diameter $D_2$ and could have other shapes as desired, such as, for example, elliptical, airfoil-shaped, etc.

An end portion 64 of the second snubber structure 28 in the embodiment shown defines a second angled surface 64*a*, which second angled surface 64*a* is spaced from a corresponding first angled surface (not shown) of an adjacent snubber structure (not shown) of an adjacent blade (not shown)

such that a second space (similar to the first space $S_1$ discussed above) is formed therebetween.

As shown in FIG. 4, the second snubber structure 28 includes an inner wall 70 that defines a hollow interior portion 72. The support structure 30 is received within the hollow interior portion 72 and affixed to the inner wall 70 as will be described in detail herein. The hollow interior portion 72 extends from the open end of the base portion 60 to an inner endwall 74 of the second snubber structure 28 that is located proximate to the end portion 64 thereof. It is noted that the inner endwall 74 could be located closer to the first blade 14*a* if desired, depending on the length of the support structure 30.

Referring to FIG. 4, the end portion 64 of the second snubber structure 28 includes a cooling fluid exit aperture 76 formed therein. The aperture 76 allows cooling fluid located in a second gap $G_2$, described below, to escape out of the second snubber structure 28. The cooling fluid may be provided into the second gap $G_2$ from the support structure 30, which support structure 30 may receive the cooling fluid from the interior cooling fluid channel 48 located within the first blade 14*a*, as noted above. It is noted that the location and number of cooling fluid exit apertures 76 formed in the second snubber structure 28 may vary as desired.

As shown in FIG. 2, the second snubber structure 28 includes antirotation structure 80, illustrated herein as an antirotation tab that extends outwardly from the base portion 60 toward the suction sidewall 22 of the first blade 14*a*. The antirotation structure 80 is received in a corresponding indentation 82 formed in the fillet 62 (see also FIG. 3) such that the second snubber structure 28 is prevented from rotating with respect to the first blade 14*a* during operation of the engine.

Figure 5:
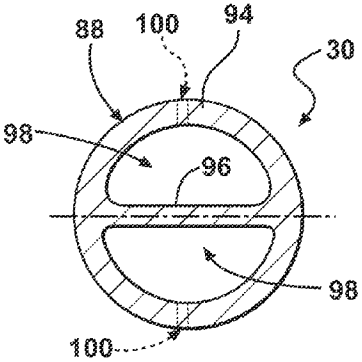
FIG. 5 is a view taken on the plane indicated by the line 5-5 in FIG. 4.

Referring to FIGS. 1, 2, 4, and 5, the support structure 30 comprises a generally cylindrical-shaped body member 88 having first and second tapered end portions 90, 92 and an intermediate portion 93 located between the first and second end portions 90, 92. As shown in FIG. 5, the body member 88 is defined by a generally cylindrical, outer wall 94 and a web member 96 that extends within the outer wall 94 to divide a hollow interior portion 98 of the body member 88. The web member 96 acts as an I-beam structure to provide structural rigidity to the support structure 30. As shown in FIGS. 1, 2, 4, and 5, the web member 96 extends in the radial direction, which improves load bearing of the support structure 30. In particular, the web member 96 and the hollow interior portion 98 provide a stiff and light support structure 30, which is used to bear centrifugal loads of the blade 14*a* during operation of the engine, as will be described in detail herein.

The intermediate portion 93 extends through a bore 95 formed in the blade 14*a* (see FIGS. 1-3), which bore 95 is formed through the blade 14*a* from the pressure sidewall 20 to the suction sidewall 22. The intermediate portion 93 is structurally coupled to the blade 14*a*, such as, for example, by shrink fitting the intermediate portion 93 of the support structure 30 into the bore 95 of the blade 14*a*, as will be described in detail herein. As shown in FIG. 2, an outer diameter $D_3$ of the intermediate portion 93 is substantially the same size as the bore 95 formed in the turbine blade 14*a*.

The hollow interior portion 98 of the body member 88 acts as a flow path for cooling fluid that enters the support structure 30 through one or more cooling fluid holes 100 (see FIGS. 2, 4, and 5) that are formed in the body member 88. The holes 100 provide fluid communication between respective passageways 48A that branch off from the interior cooling fluid channel 48 located within the first blade 14*a* and the hollow interior portion 98 of the body member 88. Specifically, the cooling fluid enters the interior cooling fluid channel 48 located within the first blade 14*a* and flows into the hollow interior portion 98 of the body member 88 through the passageways 48A and the holes 100, which holes 100 are aligned with the passageways 48A during assembly of the snubber assembly 24. The cooling fluid flowing within the hollow interior portion 98 of the body member 88 provides cooling to the support structure 30.

The end portions 90, 92 of the support structure 30 define respective openings 90A and 92A (see FIG. 4) so as to allow the cooling fluid in the hollow interior portion 98 of the body member 88 to flow out of the support structure 30 into the respective hollow interior portions 42, 72, where the cooling fluid can provide cooling to the first and second snubber structures 26, 28.

The first end portion 90 of the support structure 30 is received in the hollow interior portion 42 of the first snubber structure 26 and is coupled to the inner wall 40, such as by brazing or otherwise bonded, as will be discussed in greater detail herein. As shown in FIGS. 1, 2, and 4, the first end portion 90 is located in the hollow interior portion 42 of the first snubber structure 26 such that the first gap $G_1$ is formed between a first end surface 104 of the support structure 30 and the endwall 44 of the first snubber structure 26, which endwall 44 and the first end surface 104 of the support structure 30 face one another. The first gap $G_1$ provides a flow path for the cooling fluid in the hollow interior portion 98 of the support structure 30 to the cooling fluid exit aperture 46 formed in the first snubber structure 26 so as to allow the cooling fluid to flow out of the snubber assembly 24.

The second end portion 92 of the support structure 30 is received in the hollow interior portion 72 of the second snubber structure 28 and is coupled to the inner wall 70, such as by brazing or otherwise bonded, as will be discussed in greater detail herein. As shown in FIGS. 1, 2, and 4, the second end portion 92 is located in the hollow interior portion 72 of the second snubber structure 28 such that the second gap $G_2$ is formed between a second end surface 106 of the support structure 30 and the endwall 74 of the second snubber structure 28, which endwall 74 and the second end surface 106 of the support structure 30 face one another. The second gap $G_2$ provides a flow path for the cooling fluid in the hollow interior portion 98 of the support structure 30 to the cooling fluid exit aperture 76 formed in the second snubber structure 28 so as to allow the cooling fluid to flow out of the snubber assembly 24.

During operation of the engine, centrifugal forces are exerted on the first and second snubber structures 26, 28 as a result of the rotation of the rotor 10. These centrifugal forces cause the blades 14 to "untwist", which causes the first and second angled surfaces 34*a*, 64*a* of the respective snubber structures 26, 28 to move toward each other to engage each other with a damping force. It should be noted that it is desirable to configure the snubber structures 26, 28 to produce a damping force that is sufficient to produce damping at the interface between the snubber structures 26, 28 to control blade vibration.

As noted above, the damping forces create bending stresses, which, in prior art engines, are transferred from snubber structures to the blade pressure and suction sidewalls. However, according to aspects of the present invention, the majority of these bending stresses are transferred from the snubber structures 26, 28 to the support structure 30 and not to the blade pressure and suction sidewalls 20, 22, such that stresses exerted on the blade pressure and suction sidewalls 20, 22 are reduced.

Specifically, since the snubber structures 26, 28 are directly coupled to the support structure 30, the bending stresses exerted thereby are transferred from the snubber structures 26, 28 to the support structure 30 via the coupling of the support structure end portions 90, 92 to the inner walls 40, 70 of the respective snubber structures 26, 28. Thus, damage to the blades 14 as a result of bending stresses from the snubber structures 26, 28 is believed to be reduced, and a lifespan of the blades 14 is believed to be increased by the snubber assemblies 24. It is noted that, in the case of damage to or destruction of one or more of the components of the snubber assembly 24, the damaged portion(s) can be removed and replaced without requiring replacement of the entire blade 14.

Figure 6:
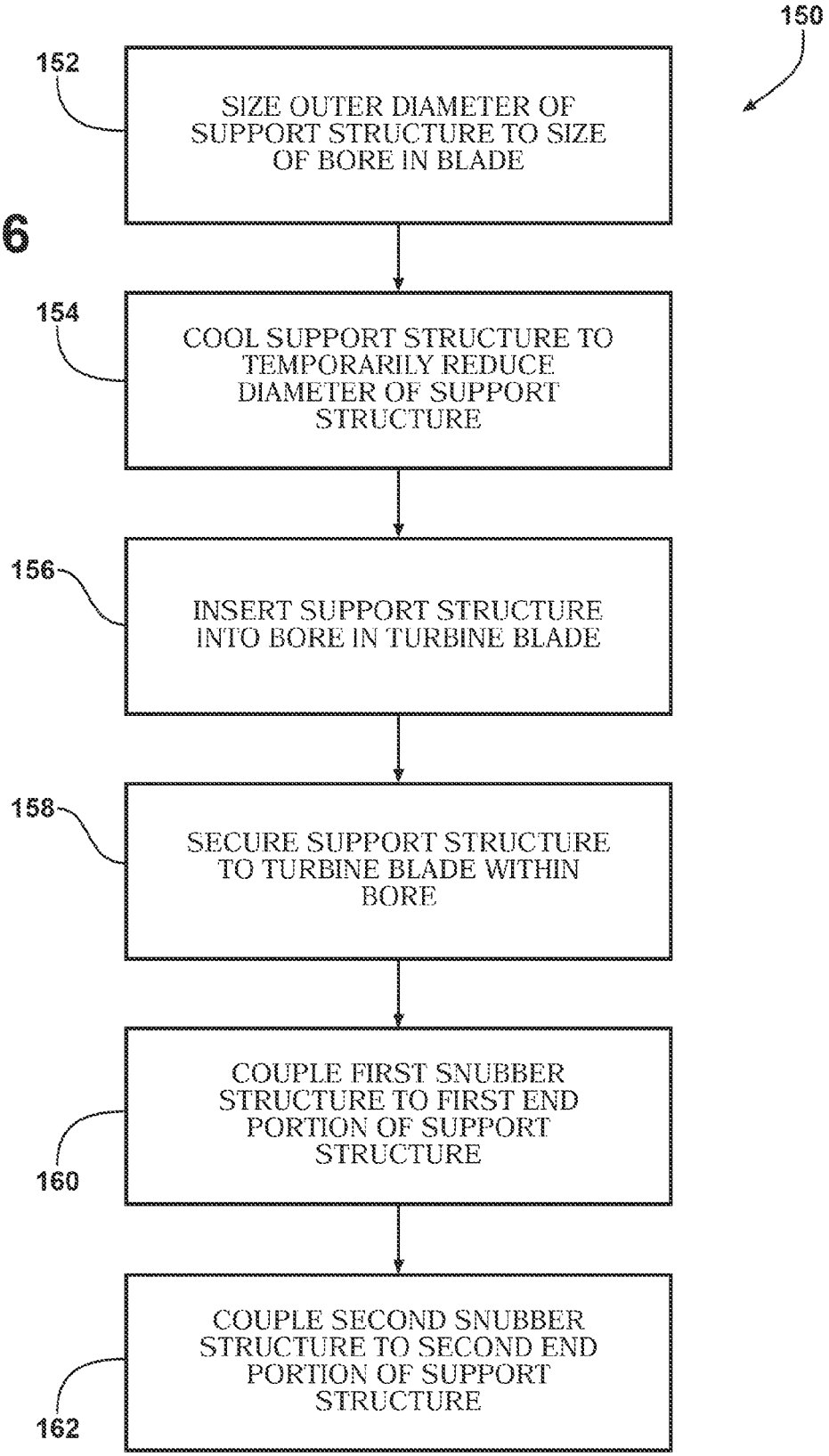
FIG. 6 is a flow chart illustrating exemplary steps for affixing a snubber assembly to a turbine blade according to an embodiment of the invention.

Referring now to FIG. 6, a method 150 is illustrated for affixing a snubber assembly, such as the snubber assembly 24 described above with reference to FIGS. 1-5, to a turbine blade having a bore formed therein, such as the blade 14*a* with the bore 95 discussed above.

At step 152, the outer diameter $D_3$ of the intermediate portion 93 of the support structure 30 is sized to be substantially the same size as the bore 95 in the turbine blade 14*a*. The outer diameter $D_3$ of the intermediate portion 93 of the support structure 30 may be sized, for example, by grinding the outer wall 94 of the support structure 30 down to the correct diameter $D_3$, e.g., by centerless grinding the intermediate portion 93.

After the outer diameter $D_3$ of the of the intermediate portion 93 of the support structure 30 is sized at step 152, the support structure 30 is cooled at step 154 to temporarily reduce the diameter $D_3$ of the intermediate portion 93 of the support structure 30, such that the support structure 30 can be inserted into the bore 95 formed in the turbine blade 14*a*. As one example, the support structure 30 may be disposed in liquid nitrogen to cool the support structure 30 down to a temperature of about −300° Fahrenheit.

Once the outer diameter $D_3$ of the support structure 30 is reduced by cooling at step 154, the support structure 30 is inserted into the bore 95 in the turbine blade 14*a* at step 156. The support structure 30 is inserted into the bore 95 in the turbine blade 14*a* such that the first end portion 90 of the support structure 30 extends outwardly from the turbine blade pressure sidewall 20 and the second end portion 92 of the support structure 30 extends outwardly from the turbine blade suction sidewall 22. Also, if cooling of the snubber assembly 24 is desired during engine operation, the support structure 30 may be inserted into the bore 95 in the turbine blade 14*a* such that holes 100 of the support structure 30 are aligned with passageways 48A that branch off from the interior cooling fluid channel 48 located within the blade 14*a*. Thus, cooling fluid provided to the interior cooling fluid channel 48 located within the blade 14*a* may flow into the hollow interior portion 98 of the support structure 30 to provide cooling to the snubber assembly 24 as discussed above.

It should be noted that, prior to insertion of the support structure 30 into the bore 95 at step 156, the support structure 30 may be turned to reduce at least a portion of the diameters $D_1$ and $D_2$ of the first and second end portions 90, 92 sufficiently to form a braze gap between the first and second end portions 90, 92 and the respective first and second snubber structures 24, 26 for receiving a brazing material.

The support structure 30 is then secured to the turbine blade 14*a* within the bore 95 at step 158. Securing the support structure 30 to the turbine blade 14*a* may comprise, for example, heating the support structure 30 such that the outer diameter $D_3$ thereof expands. Upon the expansion of the diameter $D_3$ of the support structure 30, the outer wall 94 thereof engages the turbine blade 14*a* to secure the support structure 30 to the turbine blade 14*a*, such that the support structure 30 is shrink fitted into the bore 95 of the turbine blade 14*a*. Heating the support structure 30 may comprise, for example, exposing the turbine blade 14*a* and the support structure 30 to the atmosphere and allowing the support structure 30 to heat up to atmospheric temperature. It is noted that the outer diameter $D_3$ of the support structure 30 may expand to the size of the bore 95 quite rapidly after the transition from cooling to heating, e.g., about 5-10 seconds, so it is desirable to insert the support structure 30 into the bore 95 quickly after the transition from cooling to heating. It is also noted that the support structure 30 could be heated up by inserting the turbine blade 14*a* and the support structure 30 into a heating device, such as a furnace.

At step 160, the first snubber structure 26 is coupled to the first end portion 90 of the support structure 30. Coupling the first snubber structure 26 to the first end portion 90 of the support structure 30 may comprise, for example locating a first brazing material 200 (see FIG. 4) in the hollow interior portion 42 of the first snubber structure 26 and/or on the first end portion 90 of the support structure 30 outside of the turbine blade 14*a*, and applying heat to melt the first brazing material 200. Upon a cooling of the first brazing material 200 it couples the first snubber structure 26 to the first end portion 90 of the support structure 30.

At step 162, which may be performed at the same time as step 160 or subsequent to or before step 160, the second snubber structure 28 is coupled to the second end portion 92 of the support structure 30. Coupling the second snubber structure 28 to the second end portion 92 of the support structure 30 may comprise, for example locating a second brazing material 202 (see FIG. 4) in the hollow interior portion 72 of the second snubber structure 28 and/or on the second end portion 92 of the support structure 30 outside of the turbine blade 14*a*, and applying heat to melt the second brazing material 202. Upon a cooling of the second brazing material 202 it couples the second snubber structure 28 to the second end portion 92 of the support structure 30.

In accordance with another embodiment, it may be desirable to couple one of the first or the second snubber structures 26, 28 to the support structure 30 before the support structure 30 is cooled at step 154. In this embodiment, the first or the second snubber structure 26, 28 coupled to the support structure 30 may be cooled at step 154 along with the support structure 30. Hence, when the support structure 30 is inserted into the bore 95 in the turbine blade 14*a* at step 156, the first or second snubber structure 26, 28 may act as a stop when the support structure 30 is inserted into the bore 95 the appropriate amount, i.e., the base portion 31 or 60 of the respective snubber structure 26 or 28 will contact the corresponding fillet 32, 62, such that the support structure 30 is not inserted too far through the bore 95.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A snubber assembly associated with a rotatable turbine blade in a turbine engine, the turbine blade including a pressure sidewall and a suction sidewall opposed from the pressure wall, the snubber assembly comprising:

a first snubber structure associated with the pressure sidewall of the turbine blade;

a second snubber structure associated with the suction sidewall of the turbine blade; and a support structure extending through the blade and rigidly coupled at a first end portion thereof to said first snubber structure and at a second end portion thereof to said second snubber structure;

wherein:

centrifugal loads exerted by said first and second snubber structures caused by rotation thereof during operation of the engine are at least partially transferred to said support structure such that centrifugal loads exerted on the pressure and suctions sidewalls of the turbine blade by said first and second snubber structures are reduced; and each of the blade and said first and second snubber structures are formed from the same material and said support structure is formed from a different material than the blade and said first and second snubber structures.

2. The snubber assembly of claim 1, wherein said support structure comprises an intermediate portion spanning between said first and second end portions, said intermediate portion extending through the turbine blade and having an outer diameter that is substantially the same size as a bore formed in the turbine blade that receives said support structure.

3. The snubber assembly of claim 2, wherein said intermediate portion of said support structure is shrink fitted into said bore.

4. The snubber assembly of claim 2, wherein said support structure comprises a hollow interior portion and said first and second end portions comprise openings formed therein in communication with said hollow interior portion and with respective ones of said first and second snubber structures.

5. The snubber assembly of claim 1, wherein:

said first end portion of said support structure is received in a hollow interior portion of said first snubber structure; and said second end portion of said support structure is received in a hollow interior portion of said second snubber structure.

6. The snubber assembly of claim 5, wherein:

said first end portion of said support structure is received in said first snubber structure hollow interior portion such that a first gap is formed between a first end surface of said support structure and an endwall of said first snubber structure that faces said first end surface of said support structure; and said second end portion of said support structure is received in said second snubber structure hollow interior portion such that a second gap is formed between a second end surface of said support structure and an endwall of said second snubber structure that faces said second end surface of said support structure.

7. The snubber assembly of claim 1, wherein said first snubber structure is in contact with but not affixed to the turbine blade pressure sidewall and said second snubber structure is in contact with but not affixed to the turbine blade suction sidewall.

8. The snubber assembly of claim 7, further comprising:

first antirotation structure that prevents rotation between said first snubber structure and the turbine blade pressure sidewall; and second antirotation structure that prevents rotation between said second snubber structure and the turbine blade suction sidewall.

9. A method of affixing a snubber assembly to a rotatable turbine blade of a turbine engine, the turbine blade including a pressure sidewall and a suction sidewall opposed from the pressure sidewall, the turbine blade having a bore formed therein extending from the pressure sidewall through the turbine blade to the suction sidewall, the method comprising:

sizing an outer diameter of a support structure to be substantially the same size as the bore in the turbine blade;

cooling the support structure to reduce the diameter of the support structure such that the support structure can be inserted into the bore formed in the turbine blade;

inserting the support structure into the bore in the turbine blade such that:

a first end portion of the support structure extends outwardly from the turbine blade pressure sidewall; and a second end portion of the support structure extends outwardly from the turbine blade suction sidewall;

securing the support structure to the turbine blade within the bore;

coupling a first snubber structure to the first end portion of the support structure; and coupling a second snubber structure to the second end portion of the support structure.

10. The method of claim 9, wherein securing the support structure to the turbine blade comprises;

subsequent to inserting the support structure into the bore in the turbine blade, heating the support structure such that the diameter of the support structure expands, wherein upon the expansion of the diameter of the support structure an outer wall of the support structure engages the turbine blade to secure the support structure to the turbine blade.

11. The method of claim 10, wherein heating the support structure comprises exposing the turbine blade and the support structure to atmosphere and allowing the support structure to heat gradually up to atmospheric temperature.

12. The method of claim 9, wherein cooling the support structure comprises cooling the support structure to a temperature of about −300° Fahrenheit.

13. The method of claim 12, wherein cooling the support structure comprises disposing the support structure in liquid nitrogen.

14. The method of claim 9, wherein:

coupling the first snubber structure to the first end portion of the support structure comprises:

locating a first brazing material outside of the turbine blade between a hollow interior portion of the first snubber structure and the first end portion of the support structure;

applying heat to melt the first brazing material; and wherein upon a cooling thereof the first brazing material couples the first snubber structure to the first end portion of the support structure; and coupling the second snubber structure to the second end portion of the support structure comprises:

locating a second brazing material outside of the turbine blade between a hollow interior portion of the second snubber structure and the second end portion of the support structure; and applying heat to melt the second brazing material; and wherein upon a cooling thereof the second brazing material couples the second snubber structure to the second end portion of the support structure.

15. A snubber assembly associated with a rotatable turbine blade in a turbine engine, the turbine blade including a pressure sidewall and a suction sidewall opposed from the pressure wall, the snubber assembly comprising:

a first snubber structure associated with the pressure sidewall of the turbine blade;

a second snubber structure associated with the suction sidewall of the turbine blade; and a support structure extending through the blade and rigidly coupled at a first end portion thereof to said first snubber structure and at a second end portion thereof to said second snubber structure, said support structure comprising an intermediate portion spanning between said first and second end portions, said intermediate portion extending through the turbine blade and having an outer diameter that is substantially the same size as a bore formed in the turbine blade that receives said support structure;

wherein:

centrifugal loads exerted by said first and second snubber structures caused by rotation thereof during operation of the engine are at least partially transferred to said support structure such that centrifugal loads exerted on the pressure and suctions sidewalls of the turbine blade by said first and second snubber structures are reduced; and said intermediate portion of said support structure is shrink fitted into said bore.

16. A snubber assembly associated with a rotatable turbine blade in a turbine engine, the turbine blade including a pressure sidewall and a suction sidewall opposed from the pressure wall, the snubber assembly comprising:

a first snubber structure associated with the pressure sidewall of the turbine blade;

a second snubber structure associated with the suction sidewall of the turbine blade; and a support structure extending through the blade and rigidly coupled at a first end portion thereof to said first snubber structure and at a second end portion thereof to said second snubber structure, said support structure comprising:

an intermediate portion spanning between said first and second end portions, said intermediate portion extending through the turbine blade and having an outer diameter that is substantially the same size as a bore formed in the turbine blade that receives said support structure; and a hollow interior portion, wherein said first and second end portions comprise openings formed therein in communication with said hollow interior portion and with respective ones of said first and second snubber structures;

wherein centrifugal loads exerted by said first and second snubber structures caused by rotation thereof during operation of the engine are at least partially transferred to said support structure such that centrifugal loads exerted on the pressure and suctions sidewalls of the turbine blade by said first and second snubber structures are reduced.

17. The snubber assembly of claim 16, wherein said intermediate portion of said support structure comprises at least one cooling fluid hole formed therein in communication with a cooling fluid channel in the turbine blade, said cooling fluid hole permitting cooling fluid in the cooling fluid channel to flow into said hollow interior portion of said support structure to provide cooling to said support structure, and said cooling fluid flows through said openings in said first and second end portions of said support structure to provide cooling to said first and second snubber structures.

18. The snubber assembly of claim 17, wherein each of said first and second snubber structures includes at least one exit aperture formed therein, said exit apertures providing an outlet for the cooling fluid from the cooling channel that flows through said hollow interior portion of said support structure and through said openings in said first and second end portions of said support structure to said first and second snubber structures.

19. The snubber assembly of claim 16, wherein said intermediate portion of said support structure includes an I-beam structure extending through said hollow interior portion, said I-beam structure providing structural rigidity to said support structure.

20. A snubber assembly associated with a rotatable turbine blade in a turbine engine, the turbine blade including a pressure sidewall and a suction sidewall opposed from the pressure wall, the snubber assembly comprising:

a first snubber structure associated with the pressure sidewall of the turbine blade;

a second snubber structure associated with the suction sidewall of the turbine blade; and a support structure extending through the blade and rigidly coupled at a first end portion thereof to said first snubber structure and at a second end portion thereof to said second snubber structure, wherein:

said first end portion of said support structure is received in a hollow interior portion of said first snubber structure such that a first gap is formed between a first end surface of said support structure and an endwall of said first snubber structure that faces said first end surface of said support structure; and said second end portion of said support structure is received in a hollow interior portion of said second snubber structure such that a second gap is formed between a second end surface of said support structure and an endwall of said second snubber structure that faces said second end surface of said support structure;

wherein centrifugal loads exerted by said first and second snubber structures caused by rotation thereof during operation of the engine are at least partially transferred to said support structure such that centrifugal loads exerted on the pressure and suctions sidewalls of the turbine blade by said first and second snubber structures are reduced.

* * * * *